United States Patent [19]

Jensen et al.

[11] 3,994,556

[45] Nov. 30, 1976

[54] APPARATUS FOR CLAMPING TOGETHER CONDUCTORS THAT ARE TO BE ELECTRICALLY INTERCONNECTED

[75] Inventors: Jens Peter Jensen, Augustenborg; Leif Borge Tandrup, Sonderborg, both of Denmark

[73] Assignee: Danfoss A/S, Nordborg, Denmark

[22] Filed: Nov. 3, 1975

[21] Appl. No.: 628,044

[30] Foreign Application Priority Data

Nov. 2, 1974 Germany ..... 2452091

[52] U.S. Cl. ..... 339/263 R

[51] Int. Cl.[2] ..... H01R 9/10

[58] Field of Search ..... 339/176, 263, 266, 269, 339/271, 272

[56] References Cited

UNITED STATES PATENTS

| | | | |
|---|---|---|---|
| 3,659,253 | 4/1972 | Wiessner | 339/272 A |
| 3,930,706 | 1/1976 | Obuch et al. | 339/272 R |

FOREIGN PATENTS OR APPLICATIONS

| | | | |
|---|---|---|---|
| 1,540,396 | 1/1970 | Germany | 339/176 MP |
| 1,387,426 | 3/1975 | United Kingdom | 339/272 A |

*Primary Examiner*—Joseph H. McGlynn

[57] ABSTRACT

The invention relates to an electrical junction box for use with snap-in type printed circuit board modules. The junction box is connected to some form of electrical apparatus such as an electrical motor. The junction box has terminals to which conductors from the electrical apparatus such as a motor can be clamped. The junction box has a slot with the terminals in alignment on one wall thereof. The slot receives a circuit board module which has contacts which are arranged to respectively engage the terminals in the slot.

4 Claims, 8 Drawing Figures

Figure 2:
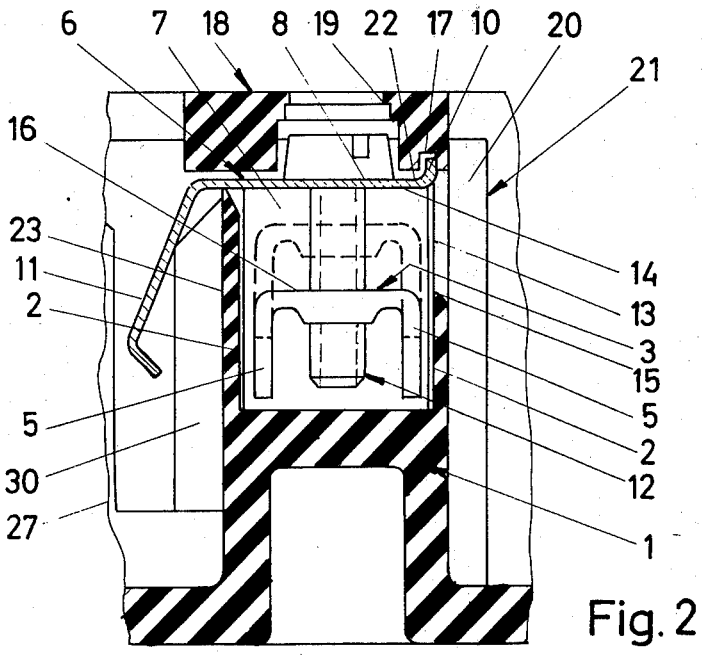

APPARATUS FOR CLAMPING TOGETHER CONDUCTORS THAT ARE TO BE ELECTRICALLY INTERCONNECTED

The invention relates to an apparatus for clamping together conductors that are to be electrically interconnected, particularly wires, comprising a screw projecting longitudinally into a guide shaft formed in the insulating housing of the apparatus, and a clamping jaw for one of the conductors longitudinally displaceable in the guide shaft by turning the screw relatively to a counterbearing, wherein the counterbearing and clamping jaw have a hole for receiving the screw and one of the holes is screw-threaded and wherein a section of one of the conductors can be introduced through a lateral aperture of the guide shaft between the clamping face of the clamping jaw and the counterbearing surface of the counterbearing.

In a known clamping apparatus of this kind, the clamping jaw is a flat quadrilateral nut. The side wall of the guide shaft terminates at such a large spacing from the counterbearing that the remaining lateral aperture just suffices for introducing a wire of a certain thickness. Now, if it is intended to clamp wires of considerably different cross-section, the thicker wires require the inlet aperture to be enlarged, i.e. the side wall to be correspondingly shortened, with the result that thinner wires could be introduced not only between the quadrilateral nut and the counterbearing but also between the quadrilateral nut and the shortened side wall. On introducing a thinner wire, care must therefore be taken that it is introduced on the correct side of the quadrilateral nut. In many cases, however, the lighting conditions in the vicinity of the clamping apparatus and/or the position of the clamping apparatus are so unfavourable, especially in the case of a clamping apparatus that is built into a different appliance at a position to which access is difficult, that the lateral inlet aperture of the guide shaft can be seen only with difficulty or not at all. In these cases difficulties are presented in introducing the wire correctly. Even with favourable viewing conditions, the assembly worker must pay more attention when introducing the wire. This complicates manipulation and, particularly with mass production, rapidly leads to tiring of the assembly worker.

The invention is based on the object of providing a clamping apparatus of the aforementioned kind that is suitable for conductors of considerably different cross-section but simplifies the introduction of all conductors regardless of cross-section.

According to the invention, this object is achieved in that at the sides of the lateral aperture of the guide shaft the clamping jaw extends longitudinally of the shaft by a length at least equal to the spacing of the counterbearing surface of the counterbearing from that edge of the lateral guide shaft aperture which lies opposite the counterbearing surface lengthwise of the guide shaft.

With this construction of the clamping apparatus, the lateral aperture of the guide shaft is blocked to such an extent by the clamping jaw and in every position of the latter that the electric conductor to be introduced can necessarily be introduced only in the space between the clamping face and the counterbearing surface. Thus, in so far that a region of the aperture permits the introduction of a conductor, this can only be the region between the clamping face and the counterbearing surface so that no particular care is required during introduction of this conductor. If necessary, introduction can even take place by feel when the view is completely blocked.

A particularly simple form for the clamping jaw is a U-shaped metal sheet of which one limb forms the extent of the clamping jaw. A clamping jaw of this construction requires little material and is nevertheless sufficiently stiff in torsion and bending to take up the forces exerted during clamping.

The counterbearing may be a U-shaped metal sheet of which the limbs project into the guide shaft and of which the yoke has the counterbearing surface, receives the screw in a hole and is provided at one edge which bounds the lateral aperture of the guide shaft with a lug which is bent out of the plane of the yoke and away from a clamped conductor. By reason of the flanging of the limbs and lug, this U plate likewise requires little material and is sufficiently stiff in torsion and bending about the same time the lug facilitates the introduction of a conductor because this lug functions in the same way as a ramp.

Preferably, provision is made that, with the hole in the clamping jaw formed with the screwthread for the screw, the guide shaft is closable by a lid after introduction of the counterbearing, clamping jaw and screw, the lid having a hole of smaller diameter than the largest diameter of the screw and permitting the passage of the shank of a screwdriver. With this construction of the clamping apparatus it is possible to hold it during introduction of a conductor in any desired position that facilitates the introduction, without the screw, clamping jaw and counterbearing falling out of the guide shaft. Preferably, the length of the screw is at least equal to the maximum displacement path available for the clamping jaw. It is then not possible to unscrew the screw fully from the clamping jaw without releasing the lid. After removing a conductor from the clamping apparatus, there is therefore no difficulty in re-introducing the screw in the screw-threaded hole before clamping the conductor back in again.

It is also advantageous if the lid has a groove for receiving the lug. The lug received in the groove on the one hand can then not complicate the introduction of a conductor during the introduction of a conductor or if the clamping apparatus is treated carelessly and on the other hand it can contribute to locating the position of the lid.

A further development consists in that at that edge of the yoke of the U plate serving as counterbearing which is opposite the lateral aperture of the guide shaft a contact lug is formed at an angle and a guide shaft aperture for introducing the clamp portion projects above the edge. A second conductor can be connected to this contact lug, e.g. by soldering or clamping. A connection can be produced particularly simply in that the second conductor is merely pressed against the contact lug. By reason of its flanging and its elasticity, the contact lug then ensures that the necessary contact pressure is maintained.

It is particularly favourable if further guide shafts of said type with a clamping jaw, a screw and a counterbearing of said type are provided in the housing in a straight row with the first-mentioned guide shaft and covered by a common lid. With this arrangement it is possible simultaneously to introduce in the lateral guide shaft aperture or bring into contact with the contact lugs a plurality of conductors that are held at a corresponding spacing from one another, e.g. the contact pins of an appropriately shaped plug.

In this connection it is advantageous if a counterbearing is disposed opposite to and at a predetermined spacing from the contact lugs. This counterbearing permits the introduction of a plug, preferably in the form of a plate with conductors printed on at the spacing of the contact lugs, between the counterbearing and the contact lugs, so that the counterbearing takes up the contact pressure exerted by the contact lugs onto the conductors of the plug and so that the plug is securely clamped.

The invention will now be described in more detail with reference to the drawings of a preferred example.

IN THE DRAWINGS

Figure 5:
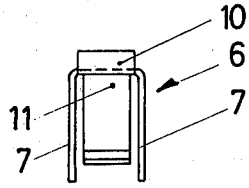
Figure 6:
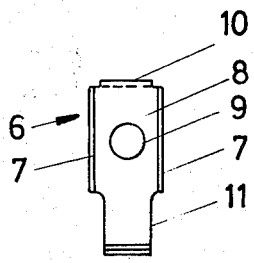
Figure 1:
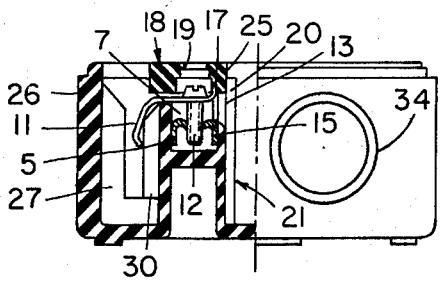
Figure 4:
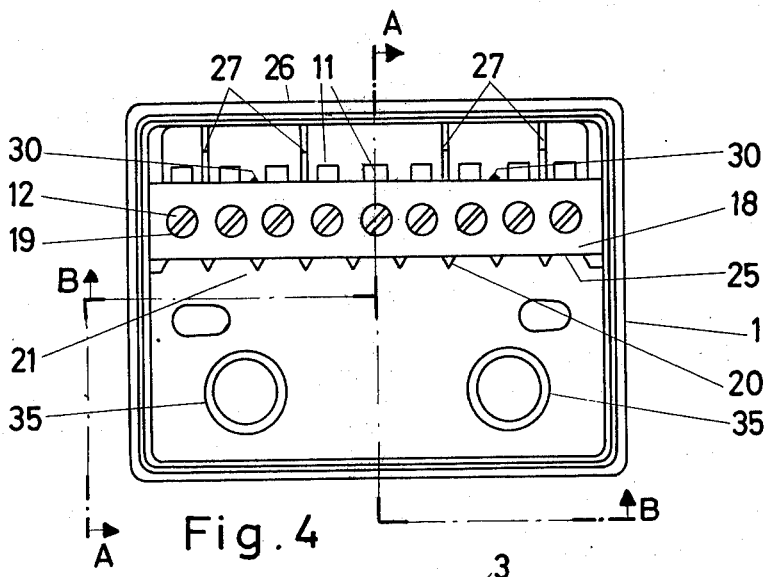
Figure 7:
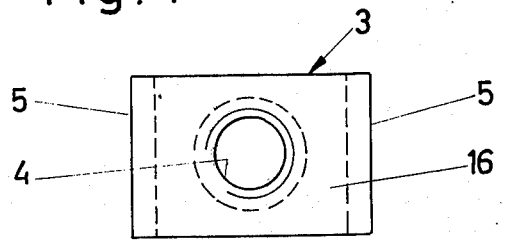
Figure 8:
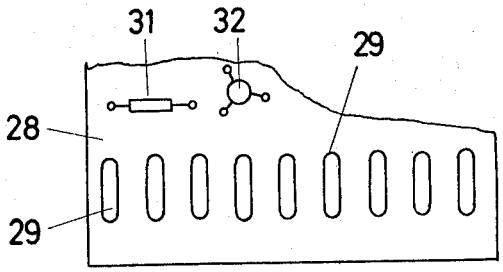
Figure 3:
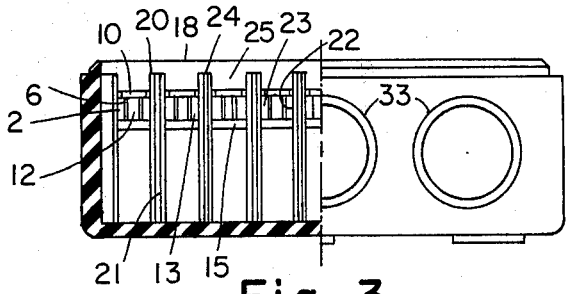

FIG. 1 is the sectional view A—A of a clamping apparatus according to the invention, FIG. 2 is an enlarged portion of the sectional view of FIG. 1, FIG. 3 is the sectional view B—B, FIG. 4 is the plan view of the clamping apparatus, FIG. 5 is the front elevation of the clamp component serving as counterbearing, FIG. 6 is the underplan of the counterbearing according to FIG. 5, FIG. 7 is the plan view of the clamp component serving as clamping jaw, and FIG. 8 is a portion of a printed circuit plate with a marginal section in the form of a plug.

The illustrated clamping apparatus comprises a plurality of guide shafts 2 juxtaposed in a row in an insulating housing 1. Slidingly guided in each guide shaft 2 there is a clamping jaw 3 of electrically conductive solid material in the form of a U-shaped metal sheet with a throughgoing screw-threaded hole 4 and two limbs 5. Further, a counterbearing 6 of electrically conductive elastic material in the form of a U-shaped metal sheet has its limbs 7 engaged in a respective guide shaft 2, the limbs 7 engaging over the clamping jaw 3 and being supported at the base of the guide shaft. A throughgoing hole 9 without a screwthread is formed in the yoke 8 of the counterbearing 6 whilst a lug 10 formed at the front edge of the yoke 8 is flanged upwardly and a contact lug 11 formed at the rear edge is flanged downwardly. The inner angle between the lug 10 and yoke 8 is about 90° whilst the inner angle between the contact lug 11 and the yoke 8 is about 110° to 115°. At the lower end the contact lug 11 is bent inwardly by about 40° to 45° so that the outer bend ensures contact with a conductor serving as a counter-contact member. Further, a screw 12 projects into each guide shaft 2, its screw-threaded shank passing with play through the hole 9 of the counterbearing 6 and engaging in the tapped hole 4 of the clamping jaw 3. The length of the screw-threaded shaft of the screw 12 is selected to be at least equal to the maximum spacing of the yokes of the counterbearing 6 and clamping jaw 3, so that the screw 12, even when its head lies against the yoke 8 of the counterbearing 6, can still engage in the tapped hole 4 of the clamping jaw 3. At the front side, each guide shaft 2 is provided with an aperture 13 serving for the introduction of a conductor, particularly a wire, between the counterbearing surface 14 of the counterbearing 6 and the clamping face 16 of the clamping jaw 3. The length of the front limb 5 of the clamping jaw 3 is chosen so that it is at least equal to the spacing of the counterbearing surface 14 of the counterbearing 6 from the opposite edge 15 of the aperture 13. This dimensioning ensures that, in each position of the clamping jaw 3 determined by turning the screw 12, the front limb 5 uncovers only that section of the aperture 13 which lies between the clamping face 16 of the clamping jaw 3 and the counterbearing surface 14 of the counterbearing 6 for the purpose of introducing a conductor that is to be clamped. This is in contrast with, for example, the construction of the clamping jaw as a simple plate which, in the position of the yoke of the clamping jaw 3 shown in broken lines and beneath the plate would in each case uncover a section of the aperture 13 for introducing a conductor. The illustrated construction permits only one possible way of introducing a conductor that is to be clamped so that this introduction can be effected solely by feel when the viewing conditions are at their worst.

The bent part of the lug 10 serves as a ramp and likewise facilitates the introduction of a conductor and engages in a groove 17 of a lid 18 which covers all the guide shafts 2 and clamp components 3, 6 and 12 and which, above each screw 12, has a hole 19 for the passage of a shank of a screwdriver. The smallest diameter of a hole 19 is somewhat less than the head diameter of a screw 12 or, in the case of a screw without a head, than the outer diameter of the screwthread, so that the screw 12 can not be completely unscrewed from the clamping jaw 3 and drop out of the clamping apparatus. The clamping apparatus can therefore be held in the position that is most favourable for introducing a conductor. The lid 18 can be adhered to the housing 1.

A ramp at the lower edge 15 of each aperture 13 similarly simplifies the introduction of a conductor. The same is achieved by means of an oblique side face 20 of forwardly converging ribs 21 which form extensions of the dividing walls 22 between the guide shafts 2 and extend to the base of an outer portion of the housing 1. Below each aperture 13, the ribs 21 therefore also bound an inlet path for introducing a conductor from below. In addition they extend leakage current paths between adjacent guide shafts 2.

The dividing walls 22 and ribs 21 project beyond the upper edge of the rear side wall 23 of the guide shafts 2 and engage in transverse grooves 24 of the lid 18. In this way they not only serve to locate the lid 18 in its longitudinal direction but also extend the leakage current paths between adjacent guide shafts 2 and limit guide paths at the front face 25 of the lid 18 between the upper ends of the ribs 21 for introducing conductors in the apertures 13 from above.

The outer wall 26 (FIGS. 1 and 4) is provided on the inner face with ribs 27 which, together with the wall 26, serve as a counterbearing for a plate 28 (FIG. 8) which is provided with a printed circuit and which can be inserted between the ribs 27 and the contact lugs 11 from above in such a way that conductors 29 on one side of the plate 28 will touch the respective contact lugs 11. The marginal section of the plate 28 that is provided with the conductors 29 at the same spacings as the contact lugs 11 therefore functions as a plug and the housing portion with the ribs 27 on the one side and further ribs 30 that form a counterbearing on the other side serves as a socket. The ribs 30 may form extensions of dividing walls 22 between guide shafts 2. The clamping force necessary for securely holding the plate 28 together with the applied components 31, 32 within the socket is exerted by the elastic contact lugs 11.

The outer wall and the base of the housing 1 comprise circular thinner wall portions 33, 34 and 35 which can be selectively broken out by the conductors that are to be introduced in the aperture 13 for the purpose of introducing a cable. The lateral passages formed by breaking out the wall portions 33, 34 are additionally provided with a screwthread for screwing in a cable ferrule. Elongated holes in the base of the housing 1 serve for the attachment of the entire clamping apparatus with the aid of screws.

A hood can be placed over the housing 1 to close the plate 28 with its components and the interior of the clamping apparatus.

Modifications of the illustrated example fall within the scope of the invention. For example, the inner portion of the housing 1 comprising the clamp components 3, 6, 12 and the guide shafts 2 can be made separately from the outer portion of the housing and secured to the base of the outer housing portion, preferably by adhesion. This simplifies manufacture of the housing by a moulding process. Further, the introduction of the conductors in the aperture 13 can be effected outside the outer housing portion before the inner housing portion is secured to the base of the outer portion.

It is also possible to omit the ribs 30 if the force of the contact lugs 11 is adequate for clamping the plate 28 or the latter is additionally held, for example by the hood.

I claim:

1. Electrical clamping apparatus comprising an insulated casing forming a plurality of rectangularly shaped guide holes arranged in a line, each of said holes being formed by front and rear walls and side walls and a floor portion, said casing having an outside wall in spaced relation to said rear walls to form a circuit board receiving slot, nut means in each of said holes, said front walls being shorter than said rear walls to form apertures, resilient electrical contact means fulcrumly supported on each of said rear walls, each of said contact means having a contact leg and an apertured anchoring leg forming an obtuse angle, each said contact leg extending downwardly and forming an acute angle with the one of said rear walls which supports it, anchor means for abuttingly supporting said anchoring legs to limit upward displacement thereof, and screw means extending through said anchoring legs into threaded engagement with said nut means for clamping conductors between said nut means and contact anchoring legs.

2. Electrical clamping apparatus in accordance with claim 1 including a cover member for said casing, said cover member being shaped to form said anchor means.

3. Electrical clamping apparatus in accordance with claim 2 wherein said anchor means is formed by groove means in said cover member.

4. Electrical clamping apparatus in accordance with claim 1 wherein each said nut means is a U-shaped element formed from sheet metal.

* * * * *